United States Patent [19]

Stewart

[11] Patent Number: 4,968,042

[45] Date of Patent: Nov. 6, 1990

[54] VOLLEYBALL NET ADJUSTER #2.

[76] Inventor: John V. Stewart, 1308 Henry Balch Dr., Orlando, Fla. 32810

[21] Appl. No.: 432,298

[22] Filed: Nov. 6, 1989

[51] Int. Cl.[5] ..... A63B 61/04; A63B 71/02

[52] U.S. Cl. ..... 273/411; 273/29 BC

[58] Field of Search ..... 273/411, 29 BB, 29 BC, 273/29 BD

[56] References Cited

U.S. PATENT DOCUMENTS

| | | | |
|---|---|---|---|
| 2,638,346 | 5/1953 | Stapleton | 273/29 BB |
| 3,940,139 | 2/1976 | Barnes | 273/411 |
| 4,153,247 | 5/1979 | Burns | 273/29 BC |

OTHER PUBLICATIONS

Jayfro 1989 Catalog, pp. 10, 11, no publication date.

Carron 1988 Catalog, p. 8, no publication date.

Senoh 1989 Catalog, pp. 3,4, no publication date.

Schelde 1989 Catalog, pp. 3, 4, no publication date.

*Primary Examiner*—William H. Grieb

[57] ABSTRACT

Apparatus for adjusting the tension the tension and height of volleyball nets, comprising winch means and a long net cable which passes from the winch, through the bottom of the net, around pulleys attached to the pole at the other end, thence through the top of the net, and back to the pole at the winch end. Thus a single winch tightens both the top and bottom of the net in unison. The hardware can be attached to a vertical slide on each pole to provide infinite vertical adjustment over a wide range. A movable pulley can be used to double the winch pull, so a lighter winch can be used and cranking is made easier.

9 Claims, 3 Drawing Sheets

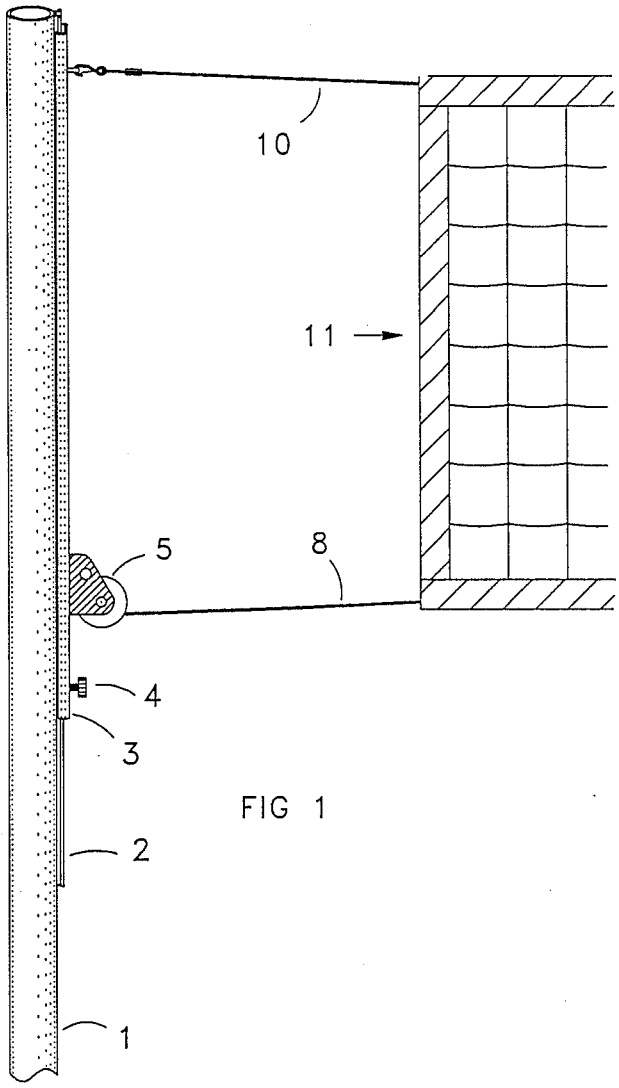
FIG 1
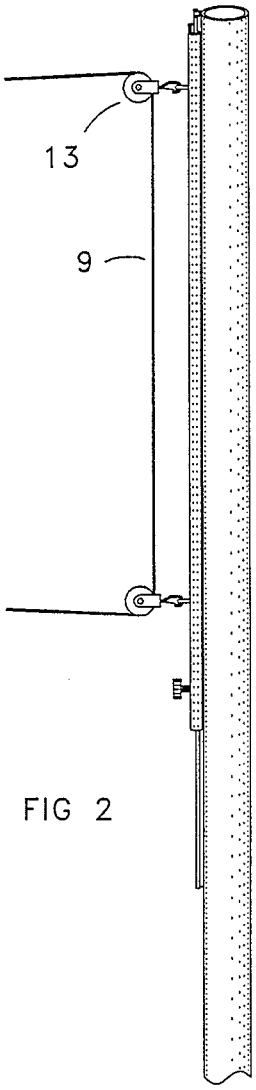
FIG 2
FIG 3
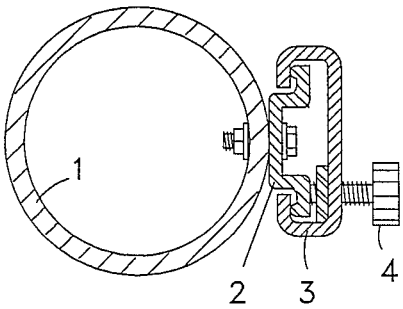

FIG 4
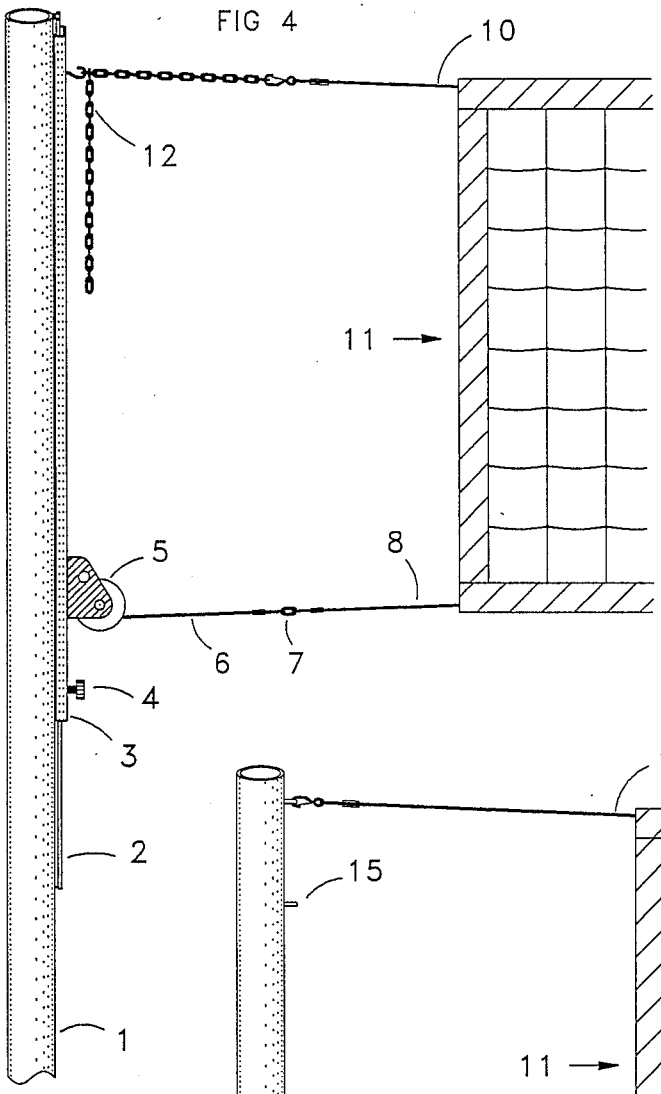
FIG 5
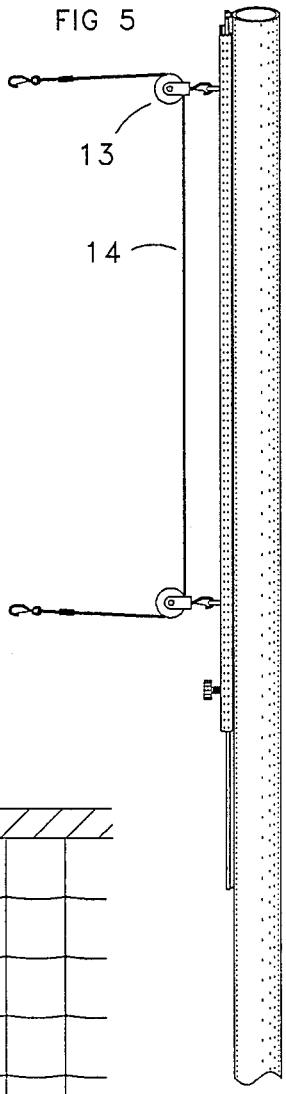
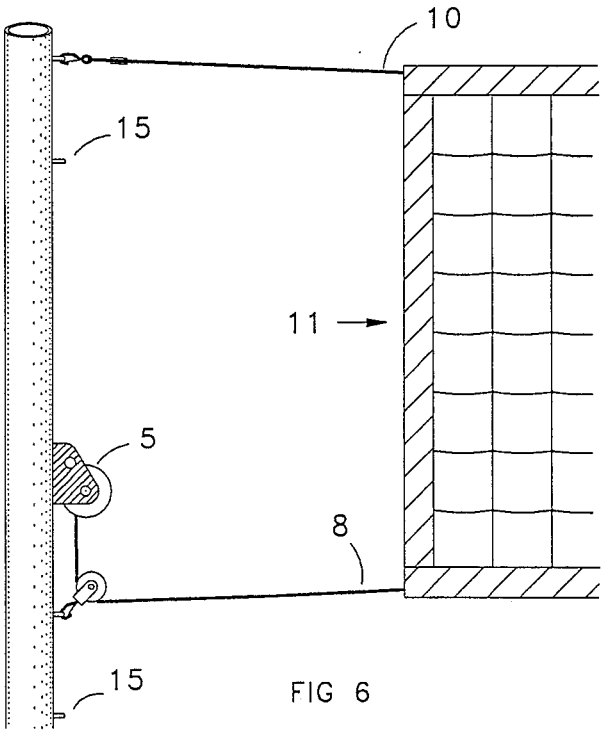
FIG 6

VOLLEYBALL NET ADJUSTER #2.

RELATED PATENT APPLICATION

Serial No. 07/377,810 filed 7/10/89.

BACKGROUND

1. Field of Invention

This invention relates to apparatus for adjusting the tension and height of volleyball nets.

2. Prior Art

Volleyball regulations require a specific net height and tension. Net height is different for men and women, and since both sexes use the same courts at different times, it is often necessary to readjust nets. Also, volleyball nets and standards at most facilities are regularly taken down for other court uses, such as basketball. Thus it would be very useful to have equipment that can be quickly and easily set-up, adjusted, and removed.

Most existing equipment lacks this convenience. The readjustment procedure on basic poles has been to disconnect the net cables and net-edge cords from the poles, move them to new attachment points, and retighten them. This is time consuming and difficult. The upper attachment point is about 2.43 meters (8 feet) above the ground, making it hard to reach. The required cable tension is hundreds of kilograms (over 500 lbs.) in the upper cable, preferably both, for net sag no greater than 2 cm. (⅜ in.) as required in current U.S. Volleyball Association regulations.

A winch is sometimes provided to make proper net tensioning feasible, but often only the upper net cable is winched. A relatively slack lower cable results in poor rebound of a ball striking the net. Sometimes a winch is provided for both the upper and lower net cables. This complicates winch positioning, forcing at least one winch to a non-optimum location on the pole (above easy reach, for example, or below the lower cable, which is a player-collision hazard). It also adds the weight and expense of the second winch.

One source of adjustment delay is iteration, or alternate tightening of the upper and lower cables until the right combination of tension and net height is approximated. When the upper cable is tightened the net rises, and when the lower cable is tightened, the net is pulled lower. Often several iterations are required, with optimum cable tension finally compromised in favor of reasonably accurate height at net center.

One type of system provides a winch on each pole—one for each cable. Adjustment requires the user to walk back and forth between the two poles during iteration, which is very inconvenient.

Another system uses a telescoping standard, to make vertical repositioning of the hardware easier. However, the upper section slides into the lower section, making it impractical to mount all the net-connection hardware on the movable section.

Another system uses a separate slide bar for each end of each cable, plus another slide bar for the winch. This requires three separate slide adjustments on the winch end of the standard, and two on the opposite end, for a total of 5. Only the upper cable is winched. A separate pulley tensioner is offered for the lower cable. As with the others, tension adjustment is iterative.

Current systems ignore the importance of proportional tension in the lower net cable to achieve ball rebound. Rebound is possibly the second major net criterion to tournament players, after accurate height.

Some systems are complex and expensive, but provide only minor benefits. None of the systems with infinite vertical adjustment can use existing poles. None appear suitable for beach doubles courts, which require a wide range of adjustment.

The related invention, referenced earlier, solves these disadvantages by routing a single winch cable to both the upper and lower net cables via pulleys, and offering a vertically-slidable mount on each pole, to which the winch and all net-connection hardware can be attached.

The present invention solves the same disadvantages in a different way, as fully described herein.

OBJECTIVES AND SUMMARY

The main objective is quick, easy adjustability of the height and tension of volleyball nets, at minimum equipment cost, and elimination of iterative tensioning of the top and bottom net cables. This is achieved by routing a single net cable from a winch, through the bottom of the net, around pulleys at the opposite end, thence through the top of the net, returning to the winch end. Thus the top and bottom net cables are tightened in unison from a single winch, using minimum hardware.

Another objective is that the mechanism be installable on existing poles and nets, so that an investment in existing equipment is not wasted. The required hardware can be bolted to existing poles, and it can be used with an existing net as is described later.

An external slide on each standard is described, to which all hardware is attached. This provides infinite vertical adjustability over a wide range, requiring only 2 slide adjustments. The net cables need not be disconnected for repositioning, making it fast and easy. The slide assembly can be bolted ot existing poles.

BRIEF DESCRIPTION OF DRAWINGS

FIG. 1 Winch end of net.

FIG. 2 Opposite end of net, showing loop of net cable (9).

FIG. 3 Sectional view through standard and slide, showing fixing bolt.

FIG. 4 Same view as FIG. 1, showing enhancements (7, 12).

FIG. 5 Same view as FIG. 2, showing short pulley cable (14).

FIG. 6 Non-slide embodiment, with alternate connecting points (15).

DRAWINGS REFERENCE NUMERALS

Figure 7:
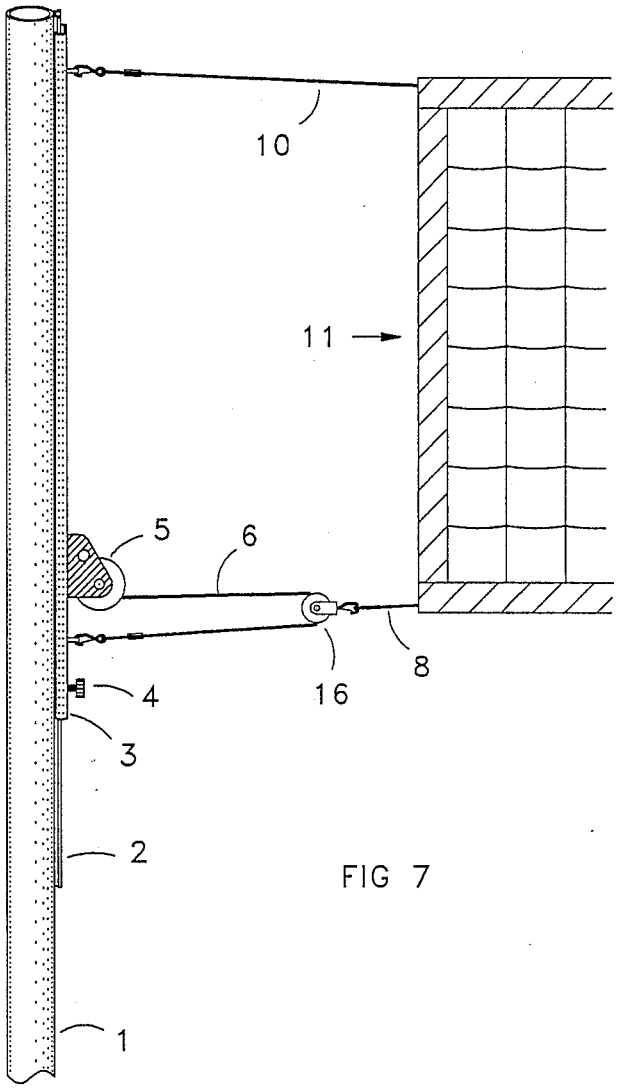
FIG. 7 Embodiment with movable pulley (16), to double the winch pull.

1 Pole or standard
2 Track
3 Slide
4 Fixing bolt (holds slide until tension is applied to cables)
5 Winch means
6 Winch cable
7 Cable coupling means
8 Lower portion of net cable
9 Loop at middle of net cable
10 Upper portion of net cable
11 Net
12 Cable length adjustment means
13 Stationary pulley
14 Short pulley cable
15 Alternate connections 16 Movable pulley

DESCRIPTION

FIG. 1 shows a winch (5) connected to the lower portion of a net cable (8). This cable passes through the lower net tape to the opposite standard, where it is routed via pulleys (13) to the upper net tape, returning therethrough to the winch end.

The winch and cable connections are attached to a standard via a slide (3) which provides infinite vertical adjustment without disconnecting the cables, and a wide range of adjustment, which is highly preferred for sand courts, where court level changes over time.

To use an existing net with this invention, the existing upper and lower net cables are replaced with a single long net cable. Pulleys (13) are threaded onto the cable before it is threaded through the bottom and top of the net.

The net cable can be attached directly to the winch, as in FIG. 1, or coupled to a winch cable, as in FIG. 4, with a snap hook, chain coupling link, or the like (7). Cable length-adjustment means, such as a chain (12), can be provided to compensate for differences in separation of the poles. Another means for length-adjustment is shown in the related application—a fixed pulley and series of cleats.

It is possible to use the existing cables of a net, assuming they are of equal strength. A short piece of cable (14) can be provided, which passes through the pulleys (13), and has means for end attachment to the existing cables. The short cable should be about 1.5 meters (5 feet) long, and be centered when installed, so its ends do not pass through the pulleys or enter the net tape when the cable is tightened. Centering is done with length-adjustment means (12).

FIG. 7 shows a winching enhancement, using a movable pulley (16) to double the winch force. This allows the use of a light winch, thus reducing weight and expense, and makes cranking easier.

Another option (not shown) is to position the winch as in FIG. 6, but reverse the direction of the cable, routing it first to the top of the net via a pulley connected to the upper attachment point. Winch force could be doubled in this configuration by a movable pulley at the top, rather than the bottom as in FIG. 7.

PREFERRED EMBODIMENT

The FIG. 7 embodiment is preferred, since it is the most convenient and flexible. It is especially preferred in the case of sand courts. For tournament-grade facilities, the net cable(s) should be steel, or equivalent.

OPERATION

The FIG. 1 embodiment is adjusted by loosening the winch, loosening the fixing bolt (4) and repositioning the slide on each side, then tightening the winch. No cables or cords need to be disconnected during the operation. The positions for the bottom of the slide can be marked on the standard or track for men's and women's heights, so that subsequent tape measuring of net height is unnecessary.

TERMINOLOGY

A "detachable intermediate section" is shown by example in FIG. 5 as a length of cable (14) with a snap hook at each end.

I claim:

1. A volleyball net tension and height adjuster, comprising:
   - first and second tracks attached to first and second volleyball net standards respectively;
   - first and second slides slidably mounted on said first and second tracks;
   - means for releasable fixing said slides at adjustable positions on said tracks;
   - winch means for adjustable tensioning of cable;
   - said winch means attached to said first slide;
   - a net cable routed from said winch means to said second slide, then around pulleys attached to said second slide, and back to connect to said first slide.

2. The apparatus of claim 1, wherein said fixing means is frictional, whereby positioning of the slides is infinitely adjustable.

3. The apparatus of claim 1, wherein said net cable includes a detachable intermediate section.

4. The apparatus of claim 1, wherein said winch means includes a winch cable trained around a movable pulley, and said net cable is attached to said movable pulley.

5. The apparatus of claim 1, wherein said net cable is routed from said winch means first to a lower portion between said slides, then to a middle portion around said pulleys, then to an upper portion between said slides.

6. A volleyball net tension and height adjuster, comprising:
   - first and second tracks attached to first and second volleyball net standards respectively;
   - first and second slides slidably mounted on said first and second tracks;
   - means for releasably fixing said slides at adjustable positions on said tracks;
   - winch means for adjustable tensioning of cable;
   - said winch means attached to said first slide;
   - a winch cable, routed from said winch means to a movable pulley, thence to said first slide;
   - a net cable routed from said movable pulley to said second slide, then around pulleys attached to said second slide, and back to connect to said first slide.

7. The apparatus of claim 6, wherein said fixing means is frictional, whereby positioning of the slides is infinitely adjustable.

8. The apparatus of claim 6, wherein said net cable includes a detachable intermediate section.

9. The apparatus of claim 6, wherein said net cable is routed from said winch means first to a lower portion between said slides, then to a middle portion around said pulleys, then to an upper portion between said slides.

* * * * *